US011484124B2

(12) United States Patent
Wu

(10) Patent No.: US 11,484,124 B2
(45) Date of Patent: Nov. 1, 2022

(54) SEAT PAD

(71) Applicant: Chun-Hung Wu, New Taipei (TW)

(72) Inventor: Chun-Hung Wu, New Taipei (TW)

( * ) Notice: Subject to any disclaimer, the term of this patent is extended or adjusted under 35 U.S.C. 154(b) by 0 days.

(21) Appl. No.: 17/314,265

(22) Filed: May 7, 2021

(65) Prior Publication Data

US 2021/0353066 A1 Nov. 18, 2021

(30) Foreign Application Priority Data

May 13, 2020 (TW) ..... 109115943

(51) Int. Cl.
*A47C 7/28* (2006.01)
*A47C 7/14* (2006.01)
*A47C 27/12* (2006.01)

(52) U.S. Cl.
CPC ..... *A47C 7/14* (2013.01); *A47C 27/127* (2013.01)

(58) Field of Classification Search
CPC ..... A47C 7/14; A47C 27/127; A47C 7/282
USPC ..... 297/219.1–229, 452.56
See application file for complete search history.

(56) References Cited

U.S. PATENT DOCUMENTS 6,082,824 A * 7/2000 Chow ..... A61G 5/1045 297/452.56
6,755,477 B2 * 6/2004 Chow ..... A61G 5/1045 297/452.56
7,774,880 B1 * 8/2010 Botts ..... A47C 7/0213 297/228.1
8,960,699 B2 * 2/2015 Sprigle ..... A61G 5/1091 297/452.56

FOREIGN PATENT DOCUMENTS

JP 2005304514 A 11/2005

* cited by examiner

*Primary Examiner* — Rodney B White
(74) *Attorney, Agent, or Firm* — Muncy, Geissler, Olds & Lowe, P.C.

(57) ABSTRACT

A seat pad includes a supporting device, a shaping positioning portion, and an elastic member. The supporting device has a receiving space. The shaping positioning portion is at the outer periphery of the receiving space. The elastic member is arranged in the receiving space of the supporting device. The elastic member includes a contact surface in the shaping positioning portion, and the contact surface can be seated by a buttock of a user to hold the buttock of the user.

18 Claims, 5 Drawing Sheets

SEAT PAD

CROSS-REFERENCE TO RELATED APPLICATION

This non-provisional application claims priority under 35 U.S.C. § 119(a) to Patent Application No. 109115943 filed in Taiwan, R.O.C. on May 13, 2020, the entire contents of which are hereby incorporated by reference.

BACKGROUND

Technical Field

The instant disclosure relates to pad, in particular, to a seat pad.

Related Art

Exercise is good for health. Nowadays people tend to sit in prolonged time and with same gestures. For instance, office workers sit in front of their office desks in prolonged time, elders sit on the sofas in prolonged time, and teenagers sit in front of their game machines in prolonged time. As time passes, these people not only tend to feel tired but also deviate from performing correct body gestures unconsciously. As a result, issues about muscles, spine, or joints of the user occur.

SUMMARY

The chair-type massage machine known to the inventor is provided for being seated and for shaping the user's buttock. When the user sits on the chair-type massaging machine to exercise, muscles of the user can be trained, the body of the user can be fit, and the buttock of the user can be shaped.

In view of this, in one embodiment, a seat pad is provided. The seat pad comprises a supporting device, a shaping positioning portion, and at least one elastic member. The supporting device is an outer periphery component. An inner portion of the supporting device has a receiving space. The elastic member is arranged with the supporting device and comprises a contact surface in the receiving space. The contact surface is a single-layered surface and is capable of being seated by a buttock of a user to hold the buttock of the user. The shaping positioning portion is at the elastic member and is at an outer periphery of the contact surface. The contact surface of the elastic member is at an inner portion of the shaping positioning portion. A first gap is between the shaping positioning portion and the elastic member.

In some embodiments, the elastic member further comprises a soft texture layer, the seat pad further comprises a hard cloth layer at a surface of the elastic member. The hard cloth layer and the soft texture layer together form a separated two-layered cloth structure.

In some embodiments, the seat pad comprises a plurality of the elastic members. The elastic members comprise a plurality of soft texture layers. The seat pad further comprises a hard cloth layer at a surface of a bottommost elastic member of the elastic members. The shaping positioning portion is connected between an outer periphery of the bottommost elastic member and the hard cloth layer. A second gap is between the soft texture layers.

In some embodiments, the elastic members comprise a first retractable region and a second retractable region. An outer periphery of the first retractable region is connected to the supporting device, and an outer periphery of the second retractable region is connected to the shaping positioning portion.

In some embodiments, the bottommost elastic member and an elastic member on the bottom elastic member are slidable relative to each other along a length direction and a width direction of the seat pad, or the bottommost elastic member and the hard cloth layer are slidable relative to each other along the length direction and the width direction of the seat pad.

In some embodiments, a partial contact region is between the elastic members, and in the partial contact region, the elastic members rub each other.

In some embodiments, a sectioned flange portion or a positioning notch having gradually increased thicknesses is formed on the shaping positioning portion. The sectioned flange portion of the positioning notch corresponds to the outer periphery of the contact surface for elastically shaping.

In some embodiments, the seat pad further comprises a plurality of connection boarder lines sewed on the outer periphery of the contact surface. The connection boarder lines comprise an upper leaning portion and a lower leaning portion. The upper leaning portion is provided for being leant by an upper portion of the buttock, and the lower leaning portion is provided for being leant by a lower portion of the buttock.

In some embodiments, two connection boarder lines extend longitudinally at two sides of the upper leaning portion, and one connection boarder line extends transversely at the lower leaning portion.

In some embodiments, the seat pad further comprises a plurality of reinforcement lines at two sides of the lower leaning portion. The reinforcement lines obliquely extend from the two sides of the lower leaning portion toward a center portion of the contact surface.

According to one or some embodiments of the instant disclosure, the shaping positioning portion and the elastic member for being seated by the user's buttock and for holding the user's buttock can be moved relative to each other. Therefore, the elastic member of the seat pad can have automatic tension adjustment. Moreover, the seat pad can apply uniform pressures to the user, and the seat pad is air-permeable and moisture-wicking. When the user sits on the seat pad in prolonged time, the user does not tend to feel tired. Moreover, the seat pad is light and thin, so that the seat pad can be placed by several orientations. Thus, even when the user lies down, the seat pad still can provide the body shaping function for the user. Hence, the seat pad can be provided for adjusting the body gesture of the user. Furthermore, the elastic member provides elastic supporting and holding function for the user. The long sides and the short sides of the contact surface of the elastic member are elastically connected to the shaping positioning portion to allow the shaping positioning portion to be retractable. In the case that the number of the elastic member is plural, the elastic members are designed to have non-linear tension configuration so as to disperse the generated stress and the user's weight, and the seat pad can provide a progressive body-shaping function. Moreover, the fitted bottom portion can provide different pressure-reducing function for users with different weights, thereby achieving nursing function/purpose. When the user's buttock sits on the seat pad, the back and the wrist of the user can be properly protected, and the lumbar spine of the user can be properly positioned to prevent spraining. When the user sits on the seat pad, the body of the user can be properly positioned to prevent the user from falling off. According to one or some embodiments of the instant disclosure, the seat pad does not need sponges or foams, while the seat pad still can improve the inelastic chair or floor which are not meet the ergonomics concern, thereby the seat pad provides both the functionality and comfortableness. Moreover, the elastic member of the seat pad is air-permeable and cozy, sweat on the seat pad can be volatilized quickly, and the size of the seat pad is thin and light. Moreover, the seat pad can be stored easily and the elastic members can be detached from the chair easily for laundry.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The disclosure will become more fully understood from the detailed description given herein below for illustration only, and thus not limitative of the disclosure, wherein.

DETAILED DESCRIPTION

Figure 1:
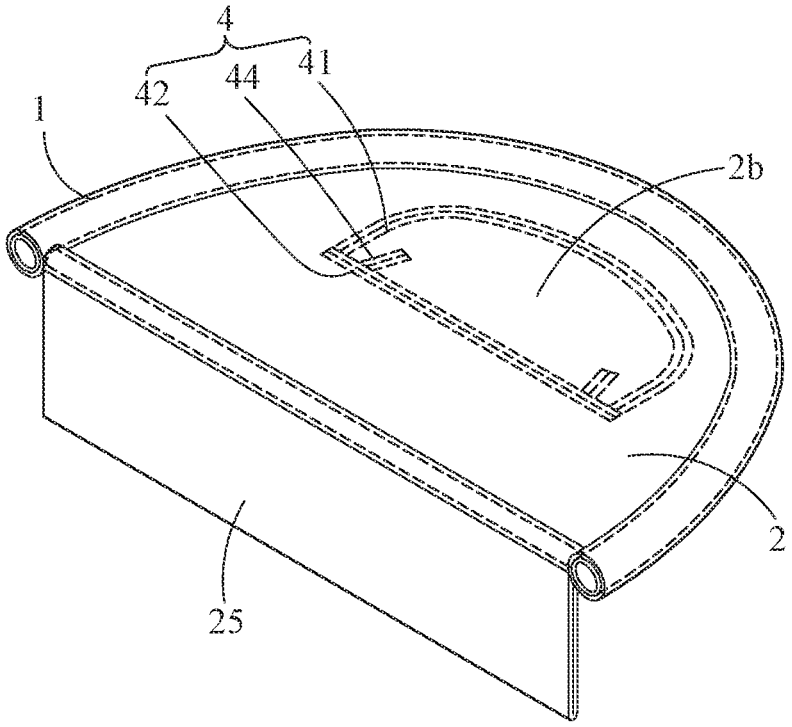
FIG. 1 illustrates a perspective view of a seat pad according to an exemplary embodiment of the instant disclosure.
Figure 2:
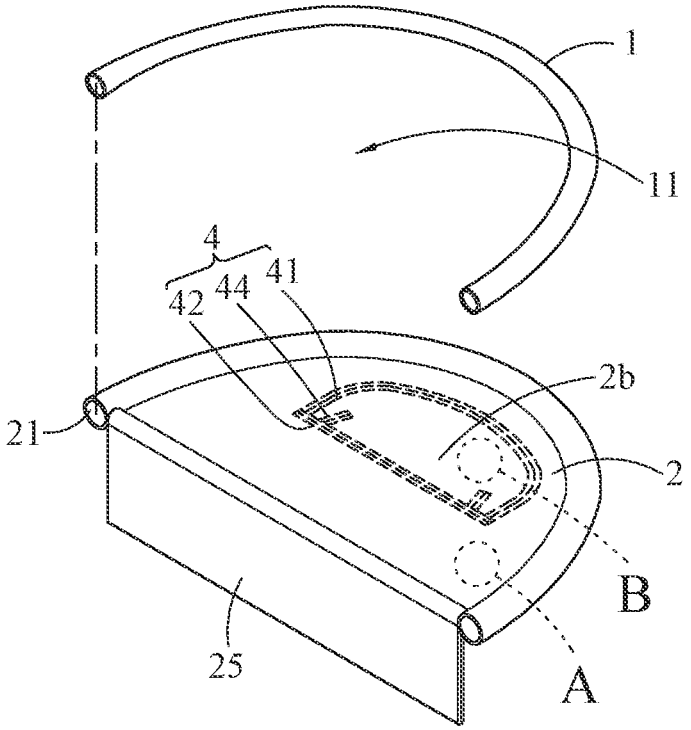
FIG. 2 illustrates an exploded view of the seat pad of the exemplary embodiment.
Figure 3A:
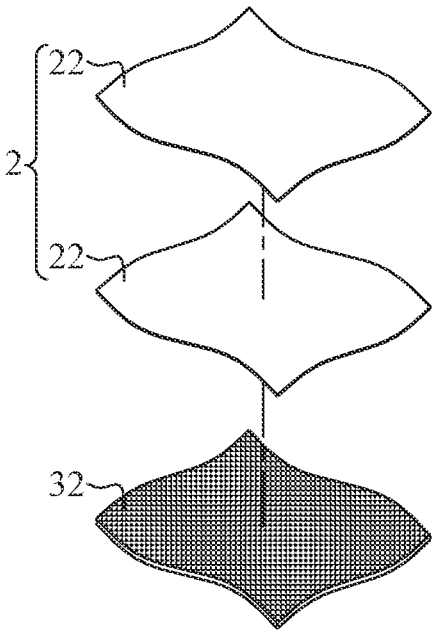
FIG. 3A illustrates an exploded view of the portion A shown in FIG. 2.
Figure 3B:
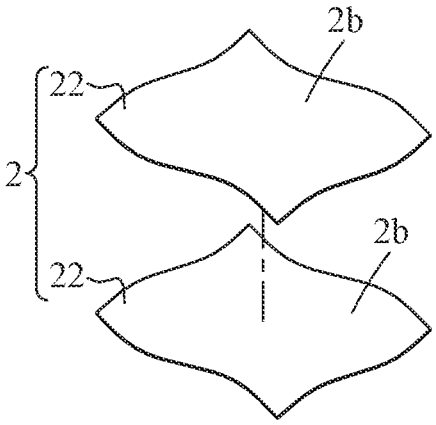
FIG. 3B illustrates an exploded view of the portion B shown in FIG. 2.
Figure 4:
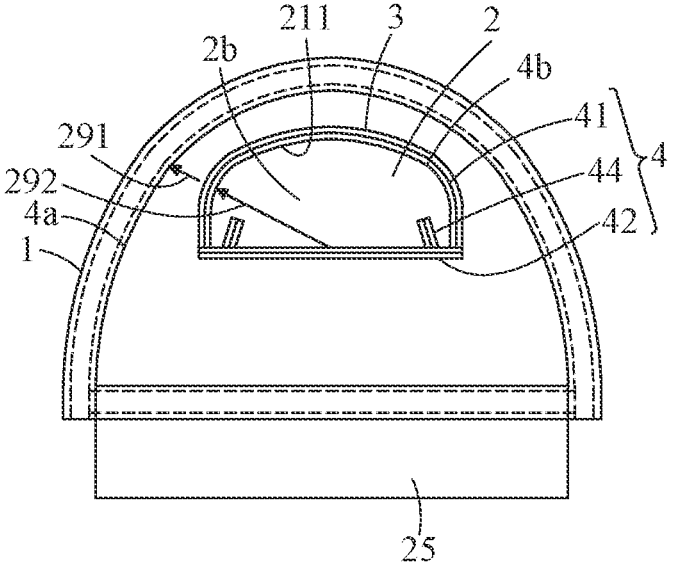
FIG. 4 illustrates a bottom view of the seat pad of the exemplary embodiment.
Figure 5:
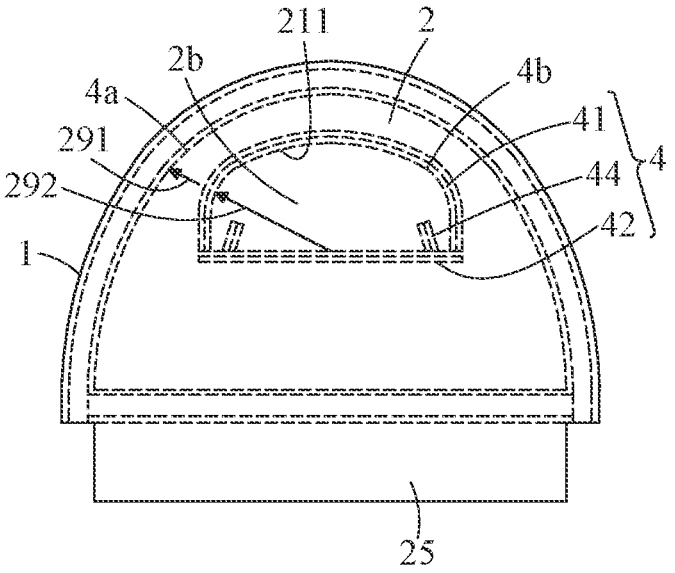
FIG. 5 illustrates a top view of the seat pad of the exemplary embodiment.
Figure 6:
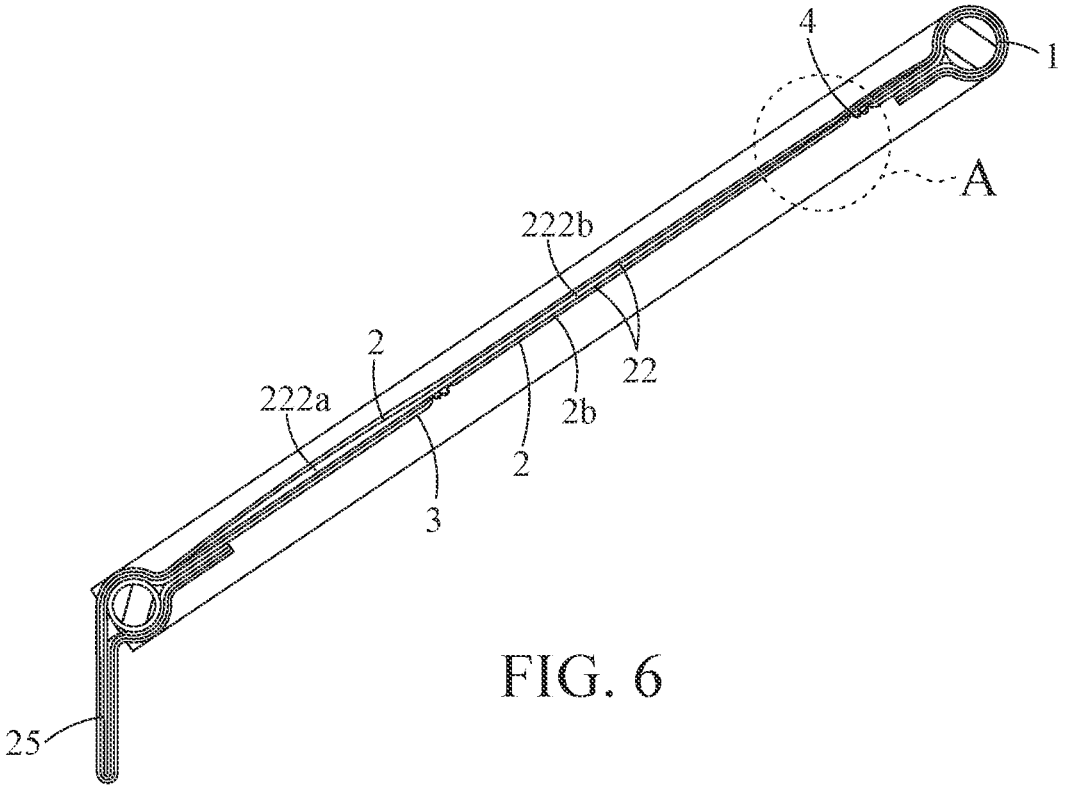
FIG. 6 illustrates a side cross-sectional view of the seat pad of the exemplary embodiment.
Figure 7A:
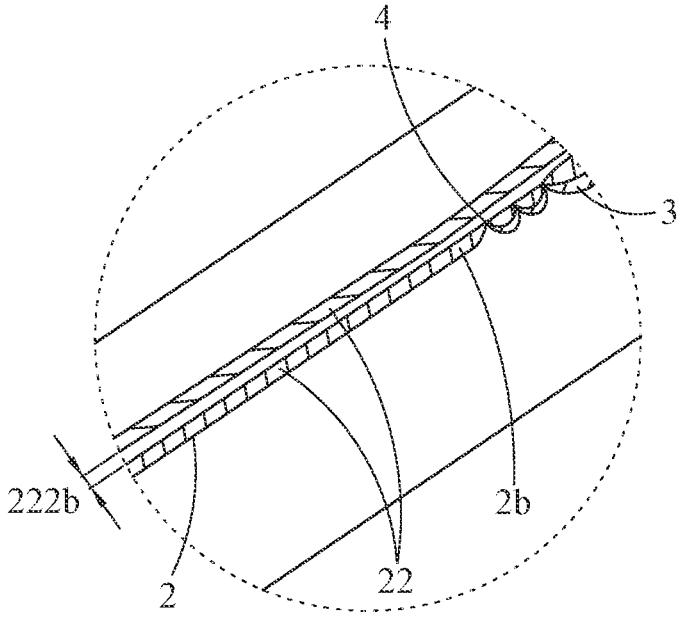
FIG. 7A illustrates an enlarged partial view of the portion A shown in FIG. 6.

Please refer to FIG. 1 to FIG. 7A, a seat pad according to an exemplary embodiment of the instant disclosure is illustrated. FIG. 1 illustrates a perspective view of the seat pad. FIG. 2 illustrates an exploded view of the seat pad. FIG. 3A illustrates an exploded view of the portion A shown in FIG. 2. FIG. 3B illustrates an exploded view of the portion B shown in FIG. 2. FIG. 4 illustrates a bottom view of the seat pad. FIG. 5 illustrates a top view of the seat pad. FIG. 6 illustrates a side cross-sectional view of the seat pad. FIG. 7A illustrates an enlarged partial view of the portion A shown in FIG. 6. In this embodiment, the seat pad comprises a supporting device 1, a shaping positioning portion 3, and at least one elastic member 2 (or a plurality of elastic members 2).

It should be noted that, the dashed lines shown in FIG. 1 and FIG. 2 are connection boarder lines 4 (in this embodiment, the connection boarder lines 4 are stitches on the seat pad). The dashed lines shown in FIG. 1 and FIG. 2 are used to indicate the connection boarder lines 4 hidden behind the elastic members 2; it should be understood that, these dash lines cannot be seen from the top of the product of the seat pad. In this embodiment, the seat pad comprises a hard cloth layer 32 and two soft texture layers 22 to form a three-layered cloth structure. Regarding the three-layered cloth structure, as shown in FIG. 1 and FIG. 2, the hard cloth layer 32 is at the bottom of the soft texture layers 22, connection boarder lines 4 are sewed between the hard cloth layer 32 and the bottommost soft texture layer 22, and the connection boarder lines 4 are not sewed on the topmost soft texture layer 22. Hence, as shown in FIG. 1 and FIG. 2, the connection boarder lines 4 cannot be seen from the top of the product, and the connection boarder lines 4 are presented by dashed lines; on the other hand, the connection boarder lines 4 can be seen from the bottom of the product.

It should be noted that, in the foregoing embodiment, the connection boarder lines 4 are presented as stitches just for illustrative purposes, and embodiments are not limited thereto. In some embodiments, the connection boarder lines 4 may be implemented by adhesives or high-frequency melting. Moreover, because of the connection boarder lines 4, the leaning portions and the contact surface of the seat pad can provide different elasticity for the user and can guide the stress applied on the seat pad to be distributed over the seat pad evenly.

In this embodiment, the supporting device 1 is an outer periphery component. An inner portion of the supporting device 1 comprises a receiving space 11.

In this embodiment, the elastic members 2 are stacked with each other. The elastic members 2 are arranged with the supporting device 1. The elastic members 2 comprise a contact surface 2*b* in the receiving space 11. The contact surface 2*b* is provided for being seated by a buttock of a user to hold the buttock of the user.

The shaping positioning portion 3 is at the elastic members 2 and at an outer periphery of the contact surface 2*b*. The contact surface 2*b* of the elastic members 2 is at an inner portion of the shaping positioning portion 3, and a first gap 222*a* is between the shaping positioning portion 3 and the elastic members 2.

In some embodiments, at least one elastic member 2 is arranged with the supporting device 1. The at least one elastic member 2 comprises a contact surface 2*b* in the receiving space 11, and the contact surface 2*b* is a single-layered surface and is provided for being seated by the buttock of the user to hold the buttock of the user.

In this embodiment, more specifically, the supporting device 1 is a hollowed tube member, and the supporting device 1 is bent to form an arc-shaped structure; the supporting device 1 may be formed as a rectangular-shaped structure or other geometrically-shaped structures.

In this embodiment, more specifically, the at least one elastic member 2 encloses the supporting device 1. The at least one elastic member 2 has a channel 21 sewed by the outer boarder lines 4*a* of the connection boarder lines 4, and the supporting device 1 is in the channel 21, but embodiments are not limited thereto. In some embodiments, a Velcro component may be disposed on the at least one elastic member 2, and the Velcro component is bent and adhered to form the channel 21, so that the supporting device 1 can pass through the channel 21 and disposed in the channel 21. When the seat pad is to be washed, the supporting device 1 can be detached from the channel 21, and the seat pad can be washed easily.

In some embodiments, the supporting device 1 may be rope, and the rope is tied to form a hanging structure having the receiving space 11 (with some points/edges fastened). In some embodiments, the supporting device 1 may be a foldable chair which may be utilized in airplanes or trains. When the seat pad is to be used, the foldable chair is pulled up to allow the foldable chair to form a hanging structure.

In this embodiment, more specifically, the shaping positioning portion 3 is formed by the hard cloth layer 32. The hard cloth layer 32 is made of canvas (as will be described in the following paragraphs), and the hard cloth layer 32 is provided as a surrounding positioning structure for the soft texture layers 22, but embodiments are not limited thereto. In some embodiments, the shaping positioning portion 3 may be a thin string to provide a low deformation effect. The shaping positioning portion 3 is connected between an outer periphery of the at least one elastic member 2 and the hard cloth layer 32.

Figure 8:
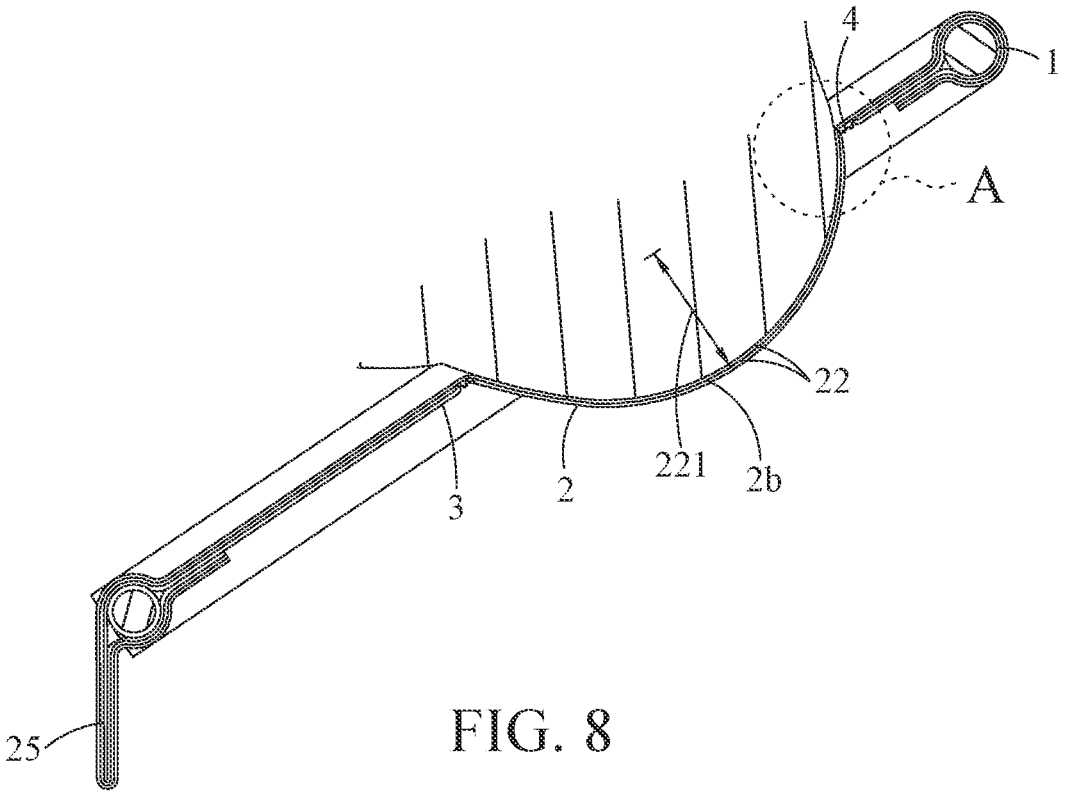
FIG. 8 illustrates a schematic side cross-sectional view showing that the seat pad of the exemplary embodiment is seated.
Figure 9A:
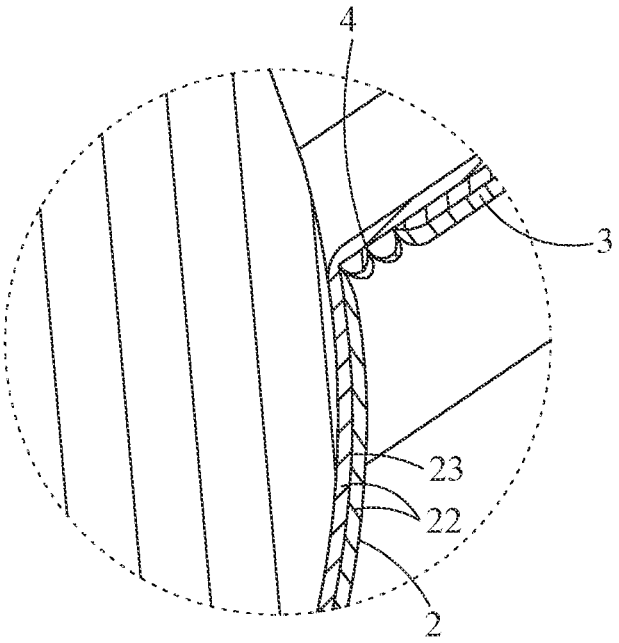
FIG. 9A illustrates an enlarged partial view of the portion A shown in FIG. 8.

Please refer to FIG. 1 to FIG. 9A. FIG. 8 illustrates a schematic side cross-sectional view showing that the seat pad is seated. FIG. 9A illustrates an enlarged partial view of the portion A shown in FIG. 8. When the seat pad is in use, the supporting device 1 forms a frame and can be placed at any environments. For example, the supporting device 1 may be placed on the sofa, and the elastic members 2 are provided for being seated by the buttock of the user (the user sits on the elastic members 2). Alternatively, the supporting device 1 may be leant against the wall, and the elastic members 2 are provided for being seated by the buttock of the user (the user sits on the elastic members 2). Alternatively, the supporting device 1 may be laid down on the bed, and the elastic members 2 are aligned with recessed portions of the bed, so that the elastic members 2 can be pressed by the buttock of the user and the user can have the buttock shaped even when the user lies down. When the buttock of the user sits on the contact surface 2*b* for shaping the buttock, the buttock can be supported by the elastic members 2.

In some embodiments, the seat pad may comprise at least one elastic member 2. The at least one member 2 comprises a soft texture layer 22, and the hard cloth layer 32 and the soft texture layer 22 together form a separated two-layered cloth structure, but embodiments are not limited thereto. In some embodiments, the seat pad comprises a plurality of elastic members 2, the elastic members 2 further comprise a plurality of soft texture layers 22, and the hard cloth layer 32 and the soft texture layers 22 form a three-layered cloth structure (as shown in FIG. 3A).

A second gap 222*b* is between the soft texture layers 22 (as shown in FIG. 6 and FIG. 7A). When the user sits on the seat pad, the soft texture layers 22 are in contact with each other and the second gap 222*b* is thus disappeared. The elastic members 2 may be formed by a plurality of springs, and the springs are arranged to form layered structures and provided for being seated by the buttock of the user.

In this embodiment, more specifically, the hard cloth layer 32 may be made of canvas. By cutting the hard cloth layer 32, the hard cloth layer 32 forms a predefined cavity to expose the contact surface 2*b* for being seated by the buttock of the user (namely, to expose portions of the soft texture layers 22). Moreover, the elastic members 2 may further comprise a mat 25, and the mat 25 is provided for being placed under the thighs and the knees of the user for protection.

In this embodiment, more specifically, the contact surface 2*b* may be a single-layered surface to provide a gentle buttock-shaping effect. When the user sits on the seat pad for buttock-shaping, no pressure-concentrated surface is formed, thus preventing the skin of the user having pressing marks or pressure ulcers under a long-time use of the seat pad.

In this embodiment, more specifically, a partial contact region 23 is between the soft texture layers 22. That is, in this embodiment, when the user sits on the seat pad, only in the partial contact region 23, the soft texture layers 22 rub each other. As mentioned, the second gap 222*b* is between the soft texture layers 22. Moreover, it is noted that, the sentence "the facing surfaces of the soft texture layers 22 form the partial rubbing (the partial contact region 23)" indicates that, when the user sits on the seat pad to apply a force (the weight of the user) with a 90-degree orientation, since the weight of the user provides different forces for different portions of the seat pad, some portions of the two soft texture layers 22 are separated from each other, while some portion of the two soft texture layers 2 are in contact with each other.

Moreover, the friction caused by the contact is proportional to the pressure. Similar to that the transmission mechanism needs the clutch for the transmission connection, when at least two separated soft texture layers 22 are applied with a sufficient pressure (body weight), even the soft texture layers 22 are elastic, the friction coefficient between the at least two separated soft texture layers 22 is still not equal to zero.

Moreover, the at least two soft texture layers 22 have different surface areas (different locations of the connection boarder lines may result different retractable ranges for the soft texture layers 22), the deformation extents of the unit area of the soft texture layers 22 for the same pressure value may be different, and the upward supporting force provided by the soft texture layers may be different. Nevertheless, in the foregoing scenarios, the distribution of the friction between the soft texture layers 22 is still related to the body shape of the user's buttock.

In other words, for the protruding portion of the user's buttock, the friction between the at least two soft texture layers 22 is larger, and the surfaces of the soft texture layers 22 are closely attached with each other and cannot slide relative to each other. In this scenario, the at least two soft texture layers 22 are substantially formed as a one-layered structure which has a lower elasticity (the elastic coefficient of the combined one-layered structure is lower than that of the individual soft texture layer). Hence, based on the mechanic principle, the combined one-layered structure can provide a buttock-shaping effect similar to a staylace or a pressure garment.

In the foregoing description, the friction between the soft texture layers 22 is proportional to the pressure applied to the soft texture layers 22 (the lesser the pressure is, the lesser the friction is; the greater the pressure is, the greater the friction is). Therefore, the soft texture layers 22 of the elastic members 2 can provide the limiting, positioning, and protection functions.

In this embodiment, more specifically, the hard cloth layer 32 in semicircle-shaped is cut to form the predefined cavity, and the predefined cavity of the hard cloth layer 32 is provided as the space for being seat by the user's buttock, and the soft texture layer 22 is disposed in the space.

In this embodiment, more specifically, the shaping positioning portion 3 forms a sectioned flange portion 211. The sectioned flange portion 211 is at the outer periphery of the contact surface 2*b* for elastically shaping the buttock of the user. In other words, the hard cloth layer 32 has the sectioned flange portion 211 for users with different buttock shapes and weights to allow the user to sit, to lean, or to have buttock-shaped. Moreover, the contact surface 2*b* can generate a space with different volumes and depths for shaping the buttock of the user for users with different buttock shapes and weights. Alternatively, in one embodiment, the shaping positioning portion 3 forms a positioning notch having gradually increased thicknesses, and the positioning notch corresponds to the outer periphery of the contact surface 2*b* for elastically shaping the buttock of the user.

In this embodiment, more specifically, the elastic members 2 comprise a first retractable region 291 and a second retractable region 292. An outer periphery of the first retractable region 291 is connected to the supporting device 1. Specifically, in this embodiment, the outer periphery of the first retractable region 291 is connected to the outer boarder lines 4*a* adjacent to the supporting device 1. Moreover, an outer periphery of the second retractable region 292 is connected to the shaping positioning portion 3 (the inner boarder lines). The area of the first retractable region 291 is greater than the area of the second retractable region 292. In other words, the soft texture layers 22 have the long side connection (the first retractable region 291) and the short side connection (the second retractable region 292), and each of the soft texture layers 22 provides different extended values and supporting tensions.

When the buttock of the user sits on the contact surface 2*b*, the portion of the soft texture layer 22 firstly contacting the user's buttock (the first retractable region 291 at the upper layer) provides a smaller unit extended value and a smaller supporting tensions, and the portion of the soft texture layer 22 that then contacting the user's buttock (the second retractable region 292 at the lower layer) provides a larger unit extended value and a larger supporting tensions. In the case that the number of the elastic members 2 is plural, the elastic members 2 are designed to have non-linear tension configuration so as to disperse the generated stress and the user's weight over the seat pad. Therefore, since the elastic members 2 of the seat pad can provide non-single elastic coefficient to prevent the retractable space 221 having excessive extension when the user has a larger weight to damage the effect of the shaping positioning portion. Hence, the seat pad can provide a progressive body-shaping function.

The retractable space 221 of the soft texture layers 22 can be provided for being seat by users with different body weights. Regarding those users with smaller body weights, the buttock of the user can be elastically supported by the upper soft texture layer 22 to prevent the buttock of the user from sinking into the retractable space 221 too much. Regarding those users with larger body weights, the buttock of the user can be elastically supported by both the upper soft texture layer 22 and the lower soft texture layer 22. As mentioned, the upper soft texture layer 22 and the lower soft texture layer 22 provide different unit deformation extents. The entire deformation of the elastic members 2 mainly attributes from the increase of the up-drawing force of the lower soft texture layer 22, so that the deformation extent of the elastic members 2 decreases, and the stress is applied over the entire soft texture layers 22.

In this embodiment, more specifically, the fitted bottom portion (the portion of the buttock of the user sitting on the contact surface 2*b*) can provide different pressure-reducing function for users with different weights, thereby achieving nursing function/purpose. When the user's buttock sits on the contact surface 2*b*, the back and the wrist of the user can be properly protected, and the lumbar spine of the user can be properly positioned to prevent spraining. Moreover, in this embodiment, the seat pad helps the disabled person or a person with different leg lengths to adjust the sitting gesture of the user.

In this embodiment, more specifically, the elastic members 2 are air-permeable, so that the sweat on the elastic members 2 can be volatilized easily. The seat pad can improve the inelastic chair or floor which are not meet the ergonomics concern, thereby the seat pad provides both the functionality and comfortableness. Moreover, the size of the seat pad is thin and light and can be stored easily, and the elastic members 2 can be detached from the chair easily for laundry.

In this embodiment, more specifically, for the soft texture layers 22, the lower soft texture layer 22 pushes the upper soft texture layer by a sliding manner, and the soft texture layers 22 are together provided as a cooperating structure for leaning and sitting. Moreover, the soft texture layers 22 are slidable relative to each other along the length direction and the width direction of the seat pad (namely, by 360 degrees). When the two separated soft texture layers 22 are not closely attached to each other, the soft texture layers 22 are in a condition similar to the clutch disks of a dry gearbox (dual-clutch transmission) and are freely slidable relative to each other. Furthermore, since the two soft texture layers 22 do not be configured coaxially (unlike the clutches in the gearbox are coaxially configured), the two soft texture layers 22 are sldiable relative to each other by 360 degrees.

When the user sits on the seat pad, most of the body weight of the user is applied on the seat pad, so that the two separated soft texture layers 22 are closely attached to each other (similar to that when the clutches are forced and attached to each other, the clutches are engaged with each other and cannot slide relative to each other). Under this condition, the two soft texture layers 22 are attached with each other to form a one-layered structure which has a lower elasticity (the elastic coefficient of the combined one-layered structure is lower than that of the individual soft texture layer 22). Hence, the seat pad can provide a feature that the elasticity of the seat pad can be changed based on the way how the user uses the seat pad. Upon sitting on the seat pad, the elasticity of the seat pad can be changed in response to the user's personal preferences or the physiological structure of the user, thus allowing different users can have optimized seating orientations and gestures.

Moreover, the soft texture layers 22 are slidable relative to each other by 360 degrees. Due to differences between the muscles, the skeletons, and the sporting coordination among humans, the step of a person whose thighs are muscular is usually larger than a person whose thighs are not muscular. In other words, since the person whose thighs are not muscular tends to use split steps forwards or backwards. The difference between muscular people and unmuscular people can be also observed in the decomposition movements of the back squat motion.

Moreover, when the difference between the muscle strength of the left leg and that of the right leg of a human is apparent, the sitting order of the left buttock and the right buttock is different, and the body weights respectively applied to the left buttock and the right buttock are also different, similar to the clutches, the soft texture layers 22 can have different elasticities and different upward supporting forces. In this embodiment, similar to that the airplane has time and space for balancing before landing off, the elasticity and the upward supporting force of the seat pad can be adjusted step by step. Therefore, the seat pad can provide protection for the user and allow the user to sit comfortably.

In this embodiment, more specifically, the seat pad further comprises a plurality of connection boarder lines 4. The connection boarder lines 4 are sewed on the outer periphery of the contact surface 2*b*. The connection boarder lines 4 comprise an upper leaning portion 41 and a lower leaning portion 42. The upper leaning portion 41 is provided for leaning against the upper portion of the buttock, and the lower leaning portion 42 is provided for leaning against the lower portion of the buttock. The upper leaning portion 41 is formed by two connection boarder lines 4 configured as a semicircle structure, and the lower leaning portion 42 is formed by on connection boarder line 4 configured transversely. Moreover, the two connection boarder lines 4 extend longitudinally at the two sides of the upper leaning portion to support the buttock and the waist of the user.

In this embodiment, more specifically, the seat pad further comprises a plurality of reinforcement lines 44 at the two sides of the lower leaning portion 42. The reinforcement lines 44 obliquely extend from the two sides of the lower leaning portion 42 toward a center portion of the contact surface 2*b*. The reinforcement lines 44 protrude from the two sides of the lower leaning portion 42. The lower leaning portion 42 is a stress plane, and the reinforcement lines 44 are at the corners of the two sides of the lower leaning portion 42. The reinforcement lines 44 are sewed with the hard cloth layer 32 and the soft texture layers 22 to reinforce the supporting and the positioning effect of the elastic members 2.

According to one or some embodiments of the instant disclosure, the shaping positioning portion and the elastic member for being seated by the user's buttock and for holding the user's buttock can be moved relative to each other. Therefore, the elastic member of the seat pad can have automatic tension adjustment. Moreover, the seat pad can apply uniform pressures to the user, and the seat pad is air-permeable and moisture-wicking. When the user sits on the seat pad in prolonged time, the user does not tend to feel tired. Moreover, the seat pad is light and thin, so that the seat pad can be placed by several orientations. Thus, even when the user lies down, the seat pad still can provide the body shaping function for the user. Hence, the seat pad can be provided for adjusting the body gesture of the user. Furthermore, the elastic member provides elastic supporting and holding function for the user. The long sides and the short sides of the contact surface of the elastic member are elastically connected to the shaping positioning portion to allow the shaping positioning portion to be retractable. In the case that the number of the elastic member is plural, the elastic members are designed to have non-linear tension configuration so as to disperse the generated stress and the user's weight, and the seat pad can provide a progressive body-shaping function. Moreover, the fitted bottom portion can provide different pressure-reducing function for users with different weights, thereby achieving nursing function/purpose. When the user's buttock sits on the seat pad, the back and the wrist of the user can be properly protected, and the lumbar spine of the user can be properly positioned to prevent spraining. When the user sits on the seat pad, the body of the user can be properly positioned to prevent the user from falling off. According to one or some embodiments of the instant disclosure, the seat pad does not need sponges or foams, while the seat pad still can improve the inelastic chair or floor which are not meet the ergonomics concern, thereby the seat pad provides both the functionality and comfortableness. Moreover, the elastic member of the seat pad is air-permeable and cozy, sweat on the seat pad can be volatilized quickly, and the size of the seat pad is thin and light. Moreover, the seat pad can be stored easily and the elastic members can be detached from the chair easily for laundry.

Chairs can maintain the natural curvature of the lumbar spine, facilitating in physical rehabilitation of the user. If the curvature of the lumbar spine of the user decreases or even disappears, when the user steps on the ground, the reaction force from the ground can be accumulated easily in the lumbar spine region, rather than being transmitted and dispersed. As a result, the user tends to have lumbago issues when the user trots. After a period of time, the user not only get the lumbago issues easily but also is easy to have chronic diseases due to the issues.

Upon sitting on a chair that is not designed properly in prolonged time and for a long time, the user's veins may be compressed to make blood flow back unsmoothly. According to one embodiment of the seat pad, the seat pad can be provided for training the pelvic floor muscles of the user to strength the buttock muscles of the user so as to prevent that the slow squirming of the intestine, the relaxation of the anus, and the bruise of the anal veins which may occur when the user sits on a chair that is not designed properly in prolonged time and for a long time. According to one embodiment of the seat pad, the veins can be prevented from being compressed to cause unsmooth blood flowing. The seat pad provides a large area to hold the user's buttock to reduce irritations. Moreover, the sitting process is similar to performing a pelvic floor exercise and is helpful in increasing the squirming of the intestine and in allowing the anal sphincter to perform the alternating contraction and relaxation motions.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A seat pad comprising:

a supporting device being an outer periphery component, wherein an inner portion of the supporting device has a receiving space;

at least one elastic member arranged with the supporting device, wherein the at least one elastic member comprises a contact surface in the receiving space, and the contact surface is a single-layered surface and is capable of being seated by a buttock of a user to hold the buttock of the user; and a shaping positioning portion at the at least one elastic member and at an outer periphery of the contact surface, wherein the contact surface of the at least one elastic member is at an inner portion of the shaping positioning portion, wherein the at least one elastic member further comprises a soft texture layer, the seat pad further comprises a hard cloth layer at a surface of the at least one elastic member, and the hard cloth layer and the soft texture layer together form a separated two-layered cloth structure.

2. The seat pad according to claim 1, further comprising a plurality of the elastic members, wherein the elastic members comprise a plurality of soft texture layers, and wherein the seat pad further comprises a hard cloth layer at a surface of a bottommost elastic member of the elastic members, the shaping positioning portion is connected between an outer periphery of the bottommost elastic member and the hard cloth layer, and a second gap is between the soft texture layers.

3. The seat pad according to claim 2, wherein a sectioned flange portion or a positioning notch having gradually increased thicknesses is formed on the shaping positioning portion, and wherein the sectioned flange portion or the positioning notch corresponds to the outer periphery of the contact surface for elastically shaping.

4. The seat pad according to claim 2, further comprising a plurality of connection boarder lines sewed on the outer periphery of the contact surface, the connection boarder lines comprise an upper leaning portion and a lower leaning portion, the upper leaning portion is provided for being leant by an upper portion of the buttock, and the lower leaning portion is provided for being leant by a lower portion of the buttock.

5. The seat pad according to claim 3, wherein two connection boarder lines extend longitudinally at two sides of the upper leaning portion, and one connection boarder line extends transversely at the lower leaning portion.

6. The seat pad according to claim 3, further comprising a plurality of reinforcement lines at two sides of the lower leaning portion, wherein the reinforcement lines obliquely extend from the two sides of the lower leaning portion toward a center portion of the contact surface.

7. The seat pad according to claim 2, wherein the elastic members comprise a first retractable region and a second retractable portion, an outer periphery of the first retractable portion is connected to the supporting device, and an outer periphery of the second retractable region is connected to the shaping positioning portion.

8. The seat pad according to claim 7, wherein a sectioned flange portion or a positioning notch having gradually increased thicknesses is formed on the shaping positioning portion, and wherein the sectioned flange portion or the positioning notch corresponds to the outer periphery of the contact surface for elastically shaping.

9. The seat pad according to claim 7, further comprising a plurality of connection boarder lines sewed on the outer periphery of the contact surface, the connection boarder lines comprise an upper leaning portion and a lower leaning portion, the upper leaning portion is provided for being leant by an upper portion of the buttock, and the lower leaning portion is provided for being leant by a lower portion of the buttock.

10. The seat pad according to claim 7, wherein the bottommost elastic member and an elastic member on the bottom elastic member are slidable relative to each other along a length direction and a width direction of the seat pad, or wherein the bottommost elastic member and the hard cloth layer are slidable relative to each other along the length direction and the width direction of the seat pad.

11. The seat pad according to claim 2, wherein a partial contact region is between the elastic members, and in the partial contact region, the elastic members rub each other.

12. The seat pad according to claim 1, wherein a sectioned flange portion or a positioning notch having gradually increased thicknesses is formed on the shaping positioning portion, and wherein the sectioned flange portion or the positioning notch corresponds to the outer periphery of the contact surface for elastically shaping.

13. A seat pad comprising:

a supporting device being an outer periphery component, wherein an inner portion of the supporting device has a receiving space;

at least one elastic member arranged with the supporting device, wherein the at least one elastic member comprises a contact surface in the receiving space, and the contact surface is a single-layered surface and is capable of being seated by a buttock of a user to hold the buttock of the user; and a shaping positioning portion at the at least one elastic member and at an outer periphery of the contact surface, wherein the contact surface of the at least one elastic member is at an inner portion of the shaping positioning portion, wherein a sectioned flange portion or a positioning notch having gradually increased thicknesses is formed on the shaping positioning portion, and wherein the sectioned flange portion or the positioning notch corresponds to the outer periphery of the contact surface for elastically shaping.

14. The seat pad according to claim 13, wherein a first gap is between the shaping positioning portion and the at least one elastic member.

15. The seat pad according to claim 1, further comprising a plurality of connection boarder lines sewed on the outer periphery of the contact surface, the connection boarder lines comprise an upper leaning portion and a lower leaning portion, the upper leaning portion is provided for being leant by an upper portion of the buttock, and the lower leaning portion is provided for being leant by a lower portion of the buttock.

16. A seat pad comprising:

a supporting device being an outer periphery component, wherein an inner portion of the supporting device has a receiving space;

at least one elastic member arranged with the supporting device, wherein the at least one elastic member comprises a contact surface in the receiving space, and the contact surface is a single-layered surface and is capable of being seated by a buttock of a user to hold the buttock of the user;

a shaping positioning portion at the at least one elastic member and at an outer periphery of the contact surface, wherein the contact surface of the at least one elastic member is at an inner portion of the shaping positioning portion; and a plurality of connection boarder lines sewed on the outer periphery of the contact surface, the connection boarder lines comprise an upper leaning portion and a lower leaning portion, the upper leaning portion is provided for being leant by an upper portion of the buttock, and the lower leaning portion is provided for being leant by a lower portion of the buttock.

17. The seat pad according to claim 16, wherein a first gap is between the shaping positioning portion and the at least one elastic member.

18. The seat pad according to claim 1, wherein a first gap is between the shaping positioning portion and the at least one elastic member.

* * * * *